United States Patent [19]

Schaller

[11] Patent Number: 4,945,800

[45] Date of Patent: Aug. 7, 1990

[54] STRINGED MUSICAL INSTRUMENT MACHINE HEAD

[76] Inventor: Helmut F. K. Schaller, Kuckucksweg 16, 8501 Feucht, Fed. Rep. of Germany

[21] Appl. No.: 410,332

[22] Filed: Sep. 21, 1989

[51] Int. Cl.[5] ..... G10D 3/14

[52] U.S. Cl. ..... 84/306; 84/204

[58] Field of Search ..... 84/204, 306

[56] References Cited

U.S. PATENT DOCUMENTS

| | | | |
|---|---|---|---|
| 4,151,778 | 5/1979 | Beattie et al. | 84/306 |
| 4,528,887 | 7/1985 | Frederick | 84/306 |
| 4,625,614 | 12/1986 | Spercel | 84/306 |

FOREIGN PATENT DOCUMENTS

| | | | |
|---|---|---|---|
| 2020876 | 11/1979 | Fed. Rep. of Germany | 84/306 |

*Primary Examiner*—Lawrence R. Franklin

[57] ABSTRACT

In a stringed musical instrument machine head, a string post is supported by a housing for rotation about its longitudinal axis and has an upper portion extending from the housing for attachment to a string and a lower portion carrying a worm wheel. A relatively long intermediate bearing portion of the post passes through an equally long bearing opening in the housing to reduce the ability of the post to wobble or shift relative to the housing, and further restraint against such unwanted movement of the post relative to the housing is provided by having the housing include a sleeve portion defining the lower part of the bearing opening and received in a recess in the worm wheel, with the worm wheel and sleeve portion of the housing also having co-engaging bearing surfaces.

7 Claims, 4 Drawing Sheets

STRINGED MUSICAL INSTRUMENT MACHINE HEAD

BACKGROUND OF THE INVENTION

This invention relates to stringed musical instruments, and deals more particularly with an improved machine head for use in attaching one end of a string to an instrument and in tensioning the string to tune it to a desired pitch.

Machine heads of the type with which the invention is concerned are commonly used as Parts of guitars, banjos and similar stringed musical instruments and are usually located on a peg head located at the outer end of the instrument's neck with each machine head being arranged to receive one of the strings of the instrument and being operable by manual rotation of an associated handle or thumb piece to tension the string so as to bring it to and hold it at a desired pitch.

The pitch or frequency of vibration of a string is very much dependent on its tension with the result that very small changes in tension produce changes in pitch which are detectable by ear. Since a machine head includes a string post to which the associated string is attached and on which the string is wound by rotation of the post about its longitudinal axis to tension the string in the tuning process, it is therefore desirable that the post have a very stable axis of rotation. That is, the post should ideally be limited to only rotational movement about its longitudinal axis and should be restrained against all other movements so that no unwanted deviation in string tension and pitch will be caused by wobbling or other erratic movement of the post.

The general object of this invention is therefore to provide an improved machine head wherein the string post is supported so as to be readily moveable in either direction about its longitudinal axis for purposes of tensioning or detensioning the associated string for tuning purposes, with the post being otherwise restrained so as to have little or no freedom of movement or play in any other direction, thereby resulting in the machine head having the ability to very smoothly increase or decrease the pitch of the associated string as the post is turned and to reliably hold the string at the selected pitch.

Other objects and advantages of the invention will be apparent from the following description and drawings describing and illustrating a preferred embodiment of the invention and from the accompanying claims.

SUMMARY OF THE INVENTION

The invention resides in a machine head adapted for attachment to the peghead of a guitar or other stringed instrument and having a housing and a string post. The string post is supported in the housing for rotation about its longitudinal axis and has an upper and extending beyond the housing for attachment to a string. A worm wheel is fixed to the lower end of the post and is rotated by a worm rotatably supported by the housing, meshing with the worm wheel and rotatable by means of a handle or thumb screw attached to it.

More specifically, the invention resides in the support means for the string post including the housing having a relatively long opening through which an intermediate or bearing portion of the post extends. The lower portion of this opening is defined by a housing sleeve portion. The worm wheel has an upwardly facing recess which receives at least a part of the sleeve portion, and the sleeve portion and worm wheel have co-engaging cylindrical bearing surfaces to restrain the post against shifting laterally. The post and the housing and the housing and the worm wheel also have co-engaging surfaces restraining the post against movement relative to the housing along the longitudinal axis of the post.

DETAILED DESCRIPTION OF THE PREFERRED EMBODIMENT

Figure 1:
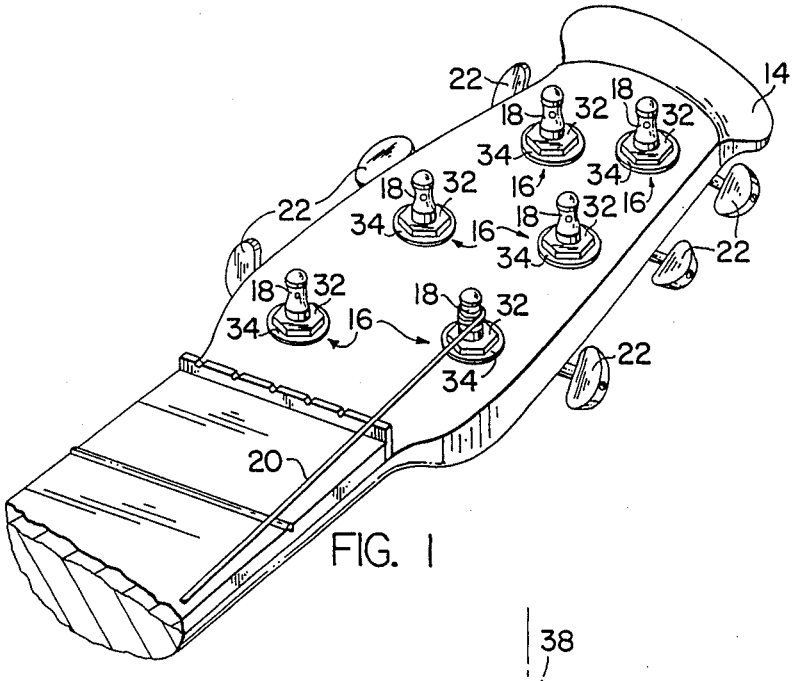
FIG. 1 is a perspective view showing the peghead of a guitar equipped with machine heads embodying the present invention.

FIG. 1 shows a typical use of a machine head of the present invention wherein the peghead 14 of a guitar carries six machine heads 16 each having an upwardly extending string post 18 connectable with an associated one of the six strings of the guitar, only one of which is illustrated at 20 in FIG. 1, and rotatable about its longitudinal axis to wind the string onto the post to bring it to the desired tension and pitch. Such rotation of the string post 18 of each machine head is accomplished by manually rotating a handle or thumb piece 22 forming part of the machine head and located to one side of the peghead 14.

Figure 2:
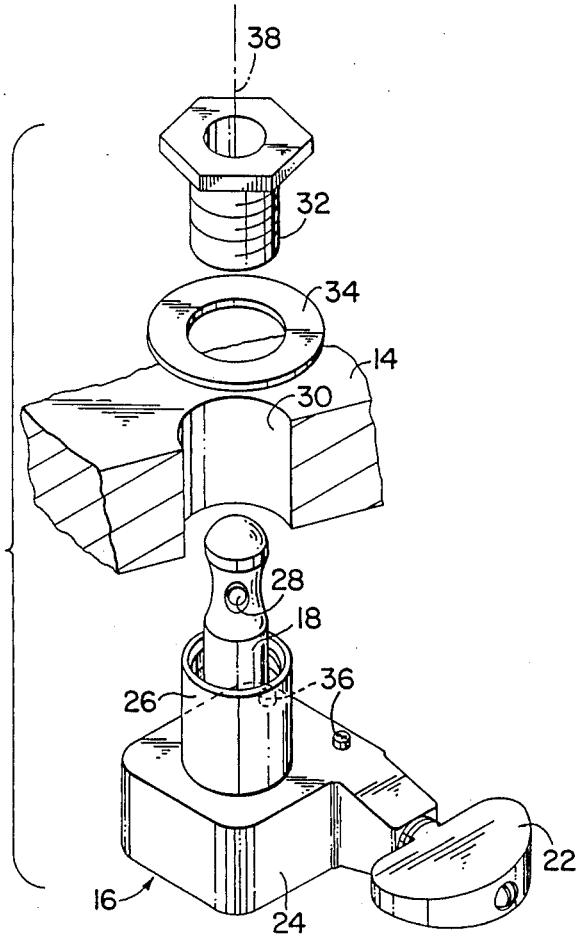
FIG. 2 is an exploded perspective view showing one of the machine heads of FIG. 1 and its manner of attachment to the peghead.

As shown in FIG. 2, each machine head 16 has a housing 24 including an upwardly extending tubular portion 26 through which the string post 18 passes, the string post having an opening 28 in its upper end through which the associated string may be passed to initially attach the string to the post to start the winding process. The tubular portion 26 of the housing passes partly through a complementary opening 30 in the peghead 14. The interior of the tubular portion 26 is threaded and threadably receives a threaded tubular bushing 32 which, when threadably tightened in the tubular sleeve 26, axially holds the machine head in place on the peg head 14. Preferably a washer 34 is placed between the head of the tubular bushing 32 and the peghead 14 to prevent marring of the peghead as the bushing is tightened into the tubular portion 26. Also, the housing 24 preferably includes one or more upwardly extending small teeth or projections, such as shown at 36, which penetrate into the peghead 14 to restrain rotation of the housing 24 relative to the peg-head about the longitudinal axis 38 of the string post 18.

Figure 3:
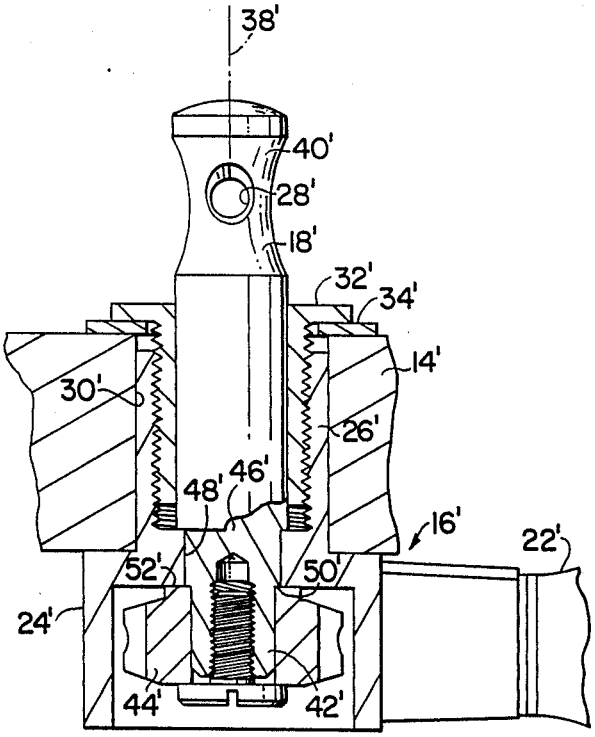
FIG. 3 PRIOR ART
FIG. 3 is a vertical sectional view taken through a machine head generally similar to that of FIG. 2 but constructed in accordance with the prior art.

Before continuing with t description of the machine head of this invention, reference is made to FIG. 3 which shows a machine head 16' generally similar to that of this invention but made in accordance with a prior art construction. Those parts of the machine head 16' of FIG. 3 which are generally similar to corresponding parts of the machine head 16 of this invention have been given the same reference numerals as the machine head 16 except for being primed. As shown in FIG. 3 the illustrated prior art machine head 16' includes housing 24' and a string post 18'. The string post has an upper end 40' and a lower end 42'. Fixed to the lower end 42' is a worm wheel 44' driven by an associated worm (not shown in FIG. 3) fixed to the handle 22'. The string post 18' is supported for rotation about its longitudinal axis 38' by having an intermediate portion 46' which passes through a complementary opening 48' in the housing with both the portion 46' and opening 48' having a relatively short axial length. A downwardly facing shoulder 50' on the post 18' and an upwardly facing shoulder 52' on the worm wheel 44' engage complementary surfaces on the housing 24' to restrain the post 18' against axial movement along the axis 38'. The fit between the post 18' and the housing 24' is usually relatively loose so that the post 18' has a fair amount of play permitting it to wobble or shift relative to the housing. The construction is further such that it is difficult to reduce this play by using close manufacturing tolerances; and slight amounts of normal wear can lead to considerable increases in play. Some play of the post is taken up when the bushing 32' is threaded into the tubular housing portion 26' due to the engagement of the post with the internal surface of the bushing; however, the fits between the bushing and the post and between the bushing and the tubular portion 26' of the housing are also generally somewhat loose so that even with the bushing in place, the string post 18' is still often free to move relative to the housing 24' more than desirable in ways other than simple rotation about its longitudinal axis 38'.

Figure 4:
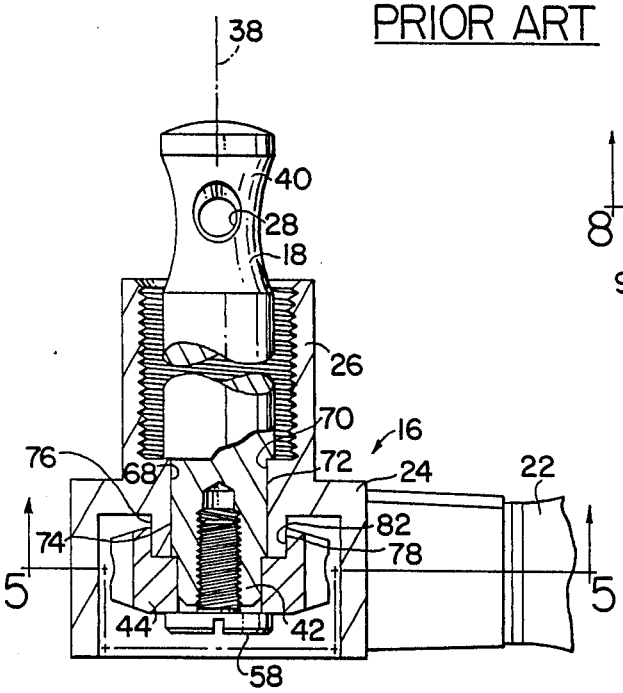
FIG. 4 is a vertical sectional view taken through the machine head of FIG. 2 and constructed in accordance with the present invention.
Figure 5:
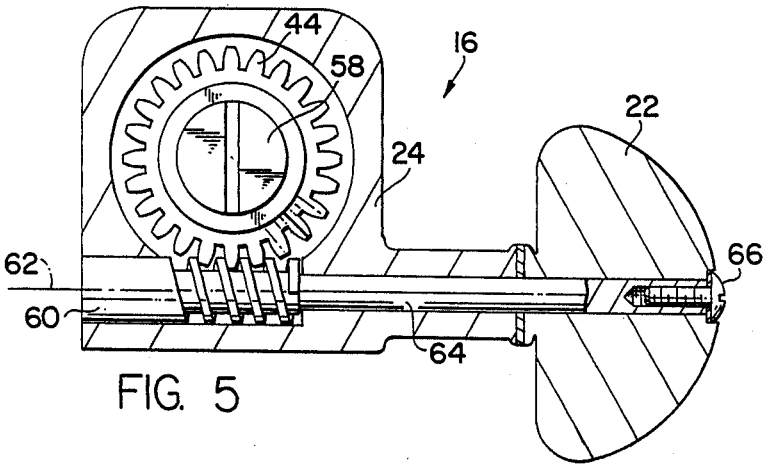
FIG. 5 is a vertical sectional view taken on the line 5—5 of FIG. 4.

In keeping with the invention, the machine head 16 of the invention is constructed to provide an improved support for the string post 18 giving the post much less play or unwanted movement relative to the housing, and which is much less susceptible to the introduction of such play through wear, in comparison to that found in prior art constructions such as that, for example, of FIG. 3. For a detailed discussion of this construction in accordance with the invention reference is now made to FIGS. 4 to 10. FIGS. 4 and 5 show the assembled machine head 16 while FIGS. 6 to 10 show various ones of its parts individually.

Figure 7:
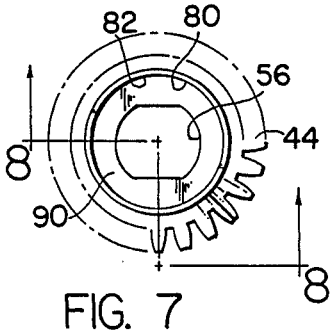
FIG. 7 is a top view of the worm wheel of FIG. 4.
Figure 8:
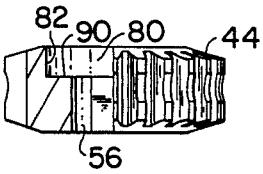
FIG. 8 is a view of the worm wheel taken on the line 8—8 of FIG. 7.
Figure 9:
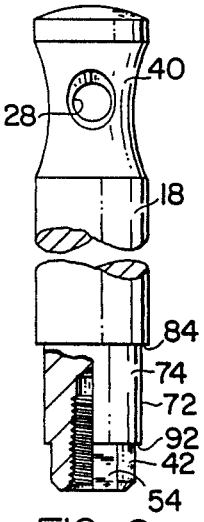
FIG. 9 is a view partly in elevation and partly in section of the string post of FIG. 4.
Figure 10:
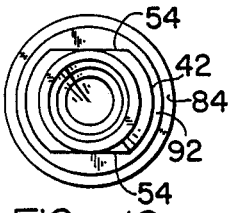
FIG. 10 is a bottom view of the string post.

Referring to FIGS. 4 to 10, the post 18 of the machine head 16 has an upper end 40 extending upwardly through and beyond the tubular portion 26 of the housing 24 and also has a lower end 42 to which is fixed a worm wheel 44. As shown in FIG. 10, the lower end 42 of the post 18 has flats 54 giving the end a non-circular cross-sectional shape, and as shown in FIG. 7 the worm wheel has a complementary opening 56 which receives the post end 42 to make the Wheel non-rotatable on the post. The wheel is held to the post by a screw 58 as shown in FIGS. 4 and 5. As shown in FIG. 5, the worm wheel 44 meshes with a worm 60 supported by the housing 24 for rotation about its longitudinal axis 62. As also seen in FIG. 5, the right hand portion of the worm 60 is in the form of a shaft 64 which extends out of the housing 24 and has non-rotatably fixed to it the handle 22 by a screw 66 and co-engaging flats (not shown) on the shaft 64 and on the handle 22.

Figure 6:
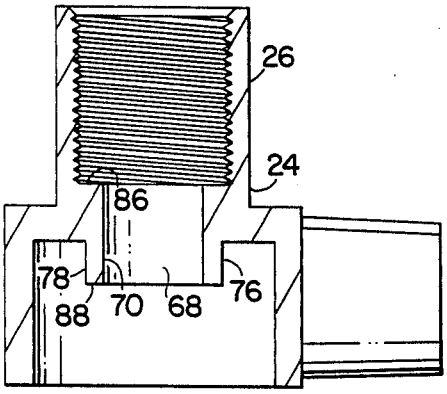
FIG. 6 is a vertical sectional view similar to FIG. 4 but showing the housing by itself.

For supporting the post 18, the housing 24 includes a relatively long vertically extending cylindrical opening 68 providing a cylindrical internal bearing surface 70 (FIG. 6). Between its upper and lower ends 40 and 42, the post 18 has an intermediate bearing portion 72 providing an external cylindrical bearing surface 74 (FIG. 9). The post bearing portion 72 extends through the housing opening 68 with the internal bearing surface 70 of the housing and the external bearing surface 74 of the post having substantially the same diameter. That is, the diameters of the bearings surfaces 70 and 74 are so chosen that the diameter of the post surface 74 is only very slightly less than the diameter of the housing surface 70 so that the post is free to turn relative to the housing about its longitudinal axis 38 while there nevertheless being little freedom for the post to move laterally relative to the housing. Yet whatever such looseness is present the ability of the post to wobble or cock in the opening 68 as a result of it is minimized due to the relatively long length of the bearing surfaces 70 and 74.

The long length of the opening 68 is achieved in part by having the housing 24 include a sleeve portion 76 at the bottom end of the opening 68, Which sleeve portion has an inner bearing surface forming part of the bearing surface 70 of the opening 68.

The sleeve portion 76 also has an external bearing surface 78, and further support for the post 18 is provided by having the worm wheel 44 include an upwardly facing recess 80 defined in part by a cylindrical internal bearing surface 82 slideably engageable with the external sleeve bearing surface 78. Again, the sleeve bearing surface 78 is only very slightly smaller than the wheel bearing surface 82 so that the wheel is freely rotatable relative to the sleeve with little lateral looseness. Whatever little lateral play or looseness does exist between the hearing surfaces 78 and 82, the fact that the surfaces 78 and 82 are of relatively large diameter means that such looseness results in a minimal ability of the post 18 to wobble or cock in the opening 68.

The post 18 is axially restrained in the housing 24 by the post having a downwardly facing shoulder 84 (FIG. 9) at the upper end of the cylindrical bearing surface 72, which shoulder 84 is engageable with an upwardly facing complementary shoulder 86 provided in the housing 24 at the upper end of the opening 68 (FIG. 6). At the lower end of the sleeve portion 76 of the housing is a downwardly facing abutment surface 88 which is engageable with the bottom surface 90 of the worm wheel 44. The worm wheel 44 is in turn accurately axially located on the post 18 by virtue of the bottom wall 90 of the wheel also engaging a downwardly facing shoulder 92 of the post 18 located at the lower end of the post bearing surface 74.

Figure 11:
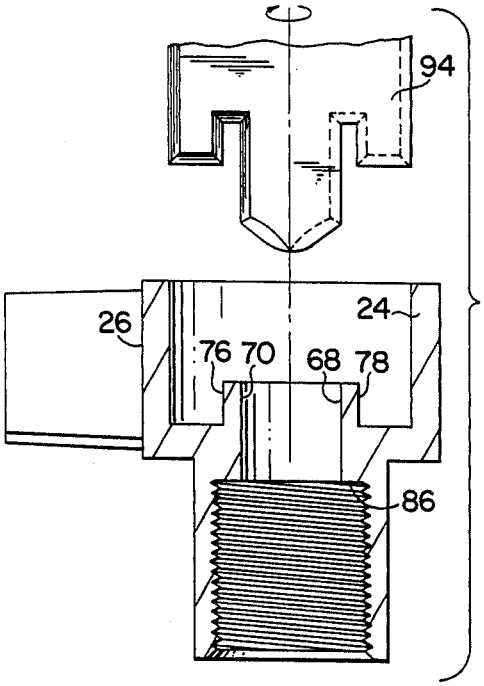
FIG. 11 is a view showing the use of a tool in machining a portion of the housing of FIG. 6.
Figure 12:
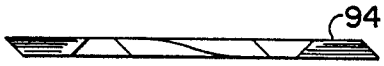
FIG. 12 is a lower end view of the tool of FIG. 11.

It is important to the operation of the machine head 16 that the bearing surfaces 70 and 78 of the housing 24 be of accurately sized diameters and be truly concentric with one another. As shown in FIGS. 11 and 12, a feature of the particular construction of the housing 24 is that the surfaces 70 and 78, and other related surfaces, may be finished by a single drill, such as that shown at 94, so as to assure consistency in the diameters of the surfaces 70 and 78 and in their concentricity.

I claim:

1. A stringed musical instrument machine head comprising:

a housing, an elongated string post having a longitudinal axis, means supporting said post for rotation about its longitudinal axis relative to said housing, said post having an upper end portion extending from said housing for attachment to a string and a lower end portion opposite said upper end portion, and a worm wheel fixed to said lower end portion of said post, said means for supporting said post for rotation relative to said housing including said housing having a vertically extending opening defining an internal cylindrical housing bearing surface, said post having an intermediate portion located between said upper and lower end portions thereof and received in and passing through said housing opening, said housing at the lower end of said opening having an annular sleeve portion with an internal surface forming part of said opening and with an external cylindrical bearing surface concentric with said opening, said worm wheel having an upwardly facing cylindrical recess receiving at least a part of said sleeve portion, said worm wheel recess being defined in part by an inwardly facing cylindrical bearing surface slideably engageable with said external bearing surface of said sleeve portion.

2. A machine head as defined in claim 1 further characterized by a worm having a longitudinal axis and supported by said housing for rotation relative to said housing about its longitudinal axis in meshing relationship with said worm wheel so that rotation of said worm about its longitudinal axis causes rotation of said post about its longitudinal axis, and a handle fixed to said worm and located externally of said housing for use in rotating said worm by hand.

3. A stringed musical instrument machine head comprising:

a housing, an elongated string post having a longitudinal axis, means supporting said post for rotation about its longitudinal axis relative to said housing, said post having an upper end portion extending from said housing for attachment to a string and a lower end portion opposite said upper end portion, and a worm wheel fixed to said lower end portion of said post, said means for supporting said post for rotation relative to said housing including said housing having a vertically extending cylindrical opening defining an internal cylindrical housing bearing surface, said post having a bearing portion located between said upper and lower end portions thereof and received in and passing through said cylindrical housing opening, said bearing portion of said post having an external cylindrical bearing surface of substantially the same diameter as said internal housing bearing surface and slideably engageable with said internal bearing surface, said housing at the lower end of said cylindrical opening having an annular sleeve portion with a internal surface forming part of said internal housing bearing surface and with an external cylindrical bearing surface concentric with said internal housing bearing surface, said worm wheel having an upwardly facing cylindrical recess receiving at least a part of said sleeve portion, said wheel recess being defined in part by an inwardly facing cylindrical bearing surface slideably engageable with said external bearing surface of said sleeve portion.

4. A machine head as defined in claim 3 further characterized by a worm having a longitudinal axis and supported by said housing for rotation relative to said housing about its longitudinal axis in meshing relationship with said worm wheel so that rotation of said worm about its longitudinal axis causes rotation of said post about its longitudinal axis, and a handle fixed to said worm and located externally of said housing for use in rotating said worm by hand.

5. A stringed musical instrument machine head comprising:

a housing, an elongated string post having a longitudinal axis, means supporting said post for rotation about its longitudinal axis relative to said housing, said post having an upper end portion extending from said housing for attachment to a string and a lower end portion opposite said upper end portion, and a worm wheel fixed to said lower end portion of said post, said means for supporting said post for rotation relative to said housing including said housing having a vertically extending cylindrical opening defining an internal cylindrical housing bearing surface, said post having a bearing portion located between said upper and lower end portions thereof and received in and passing through said cylindrical housing opening, said bearing portion of said post having an external cylindrical bearing surface of substantially the same diameter as said internal housing bearing surface and slideably engageable with said internal bearing surface, and housing at the upper end of said cylindrical opening having an upwardly facing shoulder, said post at the upper end of said bearing portion thereof having a downwardly facing shoulder engageable with said upwardly facing housing shoulder, said housing at the lower end of said cylindrical opening having an annular sleeve portion with an internal surface forming part of said internal housing bearing surface and with an external cylindrical bearing surface concentric with said internal housing bearing surface, said sleeve portion at its lower end having a downwardly facing abutment surface extending radially between said internal and external bearing surfaces of said sleeve portion, said worm wheel having an upwardly facing cylindrical recess receiving at least a part of said sleeve portion, said wheel recess being defined in part by an inwardly facing cylindrical bearing surface slideably engageable with said external bearing surface of said sleeve portion and also being defined in part by a bottom surface engageable with said downwardly facing abutment surface of said sleeve portion.

6. A machine head as defined in claim 5 further characterized by a worm having a longitudinal axis and supported by said housing for rotation relative to said housing about its longitudinal axis in meshing relationship with said worm wheel so that rotation of said worm about its longitudinal axis causes rotation of said post about its longitudinal axis, and a handle fixed to said worm and located externally of said housing for use in rotating said worm by hand.

7. A machine head as defined in claim 5 further characterized by said post at the lower end of said bearing portion having a downwardly facing shoulder engageable with said bottom surface of said worm wheel recess to determine the position of said worm wheel along the longitudinal axis of said post.

* * * * *

UNITED STATES PATENT AND TRADEMARK OFFICE

CERTIFICATE OF CORRECTION

PATENT NO. : 4,945,800

DATED : August 7, 1990

INVENTOR(S) : Schaller

It is certified that error appears in the above-identified patent and that said Letters Patent is hereby corrected as shown below:

Column 1

Line 12, delete "Parts" and substitute--parts--.
Line 56, delete the second occurrence of "and" and substitute--end--.

Column 3

Line 3, delete "t" and substitute--the--.
Line 63, delete "Wheel" and substitute--wheel--.

Column 6

Line 32, delete "and" and substitute--said--.

Signed and Sealed this

Twentieth Day of August, 1991

*Attest:*

HARRY F. MANBECK, JR.

*Attesting Officer*

*Commissioner of Patents and Trademarks*